United States Patent [19]

Collin

[11] 4,260,116

[45] Apr. 7, 1981

[54] UNWINDING STAND FOR LEVEL WIND RECLOSABLE STOCK POUCH MATERIAL AND METHODS

[75] Inventor: Everett E. Collin, Gray Court, S.C.

[73] Assignee: Nordson Corporation, Amherst, Ohio

[21] Appl. No.: 96,655

[22] Filed: Nov. 23, 1979

[51] Int. Cl.[3] ..... B65H 75/02; B65B 9/06

[52] U.S. Cl. ..... 242/55; 53/568; 242/67.3 R

[58] Field of Search ..... 242/55, 67.1 R, 67.3 R, 242/67.2; 53/384, 568; 156/515

[56] References Cited

U.S. PATENT DOCUMENTS

| | | | |
|---|---|---|---|
| Re. 28,959 | 9/1976 | Naito | 29/450 |
| Re. 28,969 | 9/1976 | Naito | 150/3 |
| Re. 29,208 | 5/1977 | Naito | 156/91 |
| Re. 29,331 | 8/1977 | Naito | 138/118 |
| 1,450,701 | 4/1923 | Murray | 242/55 X |
| 1,535,425 | 4/1925 | Little | 242/67.3 R |
| 3,083,513 | 4/1963 | Cochrane | 53/568 |
| 3,209,513 | 10/1965 | Cochrane | 53/568 |
| 3,338,284 | 8/1967 | Ausnit | 150/3 |
| 3,364,650 | 1/1968 | House | 53/568 |
| 3,380,481 | 4/1968 | Kraus | 138/118 |
| 3,492,783 | 2/1970 | Dohmeier | 53/184 |
| 3,579,404 | 5/1971 | Spitznagel | 156/515 |
| 3,583,127 | 1/1971 | Marchand . | |
| 3,699,746 | 10/1972 | Titchenal | 53/187 |
| 3,744,211 | 7/1973 | Titchenal | 53/29 |
| 3,815,317 | 6/1974 | Toss | 53/28 |
| 3,824,908 | 7/1974 | Rowell | 93/8 VB |

*Primary Examiner*—Edward J. McCarthy
*Attorney, Agent, or Firm*—Wood, Herron & Evans

[57] ABSTRACT

An unwind stand provides apparatus for aligning and tracking reclosable stock pouch material having a thickened pouch closure formation. Substantially vertical material runs provide a material path of significant distance between a level wind supply roll, from which stock material wavers transversely as it is unwound, and biased guide and alignment apparatus for aligning the material against transverse movement. Loop forming apparatus and unwinding and alignment method steps are included.

23 Claims, 6 Drawing Figures

UNWINDING STAND FOR LEVEL WIND RECLOSABLE STOCK POUCH MATERIAL AND METHODS

This invention relates to pouch forming, filling and sealing, and more particularly, to apparatus for unwinding stock pouch material and accurately feeding it to a pouch filling and sealing apparatus.

Vertical pouch filling and sealing machines are well-known in the art. Exemplary of these are the units disclosed in U.S. Pat. Nos. 3,083,513; 3,209,513; 3,364,650; and 3,579,404. In these, stock pouch material is run vertically through the equipment, sides of the material are spread, contents are inserted, and the material is sealed about its edges and around the contents to form a pouch. The filled and sealed pouch is then cut from an end of the stock material. Such machines are very desireable for numerous reasons including the fact that since they operate vertically, they require much less horizontal floor space than elongated horizontal pouch machines.

In some pouch operations, it is desireable to use a folded pouch stock material having a reclosable continuous closure formation proximate adjacent respective edges of the material. Such a closure formation ordinarily comprises an elongated male bead and a cooperating female receptacle for yieldably receiving the bead to close the pouch. In most cases, the cooperating closure parts are disposed near edges of the stock material defining a pouch top, while the pouch bottom is defined by the material fold. Sides of the pouch are defined by transverse heat seals, sealing the folded material together at intervals corresponding to pouch width.

It is now desired, however, to utilize a different pouch material wherein the closure formation comprises cooperating elongated male and female components disposed proximate the material fold, while the elongated far edges of the material are spread for pouch filling and are then sealed to form the pouch bottom. In such a configuration, lines of perforation are made in the pouch, between the closure formation and the fold, so as to require removal of the fold to gain access to the pouch through the closure. These have the advantage of providing a tamper-proof seal, and do not require the closure to be opened and closed for pouch filling and sealing.

Regardless of closure disposition, folded, reclosable stock pouch material is typically supplied to the user on reels or supply rolls, the material being once folded and the closure formation in a closed condition. Since the closure formation is normally thicker than the combined pouch sides (which may simply be a thermoplastic film such as polyethylene), the closure quickly builds up on the roll to a much larger diameter than the remainder of the material. The material edges are thus relatively loosely formed and the resulting roll is flimsy on its sides and difficult, if not impossible, to handle efficiently.

To remedy this roll supply problem, supply stock pouch material with reclosable closures is now supplied in level wound supply rolls. Such rolls are typically wider than the transverse width of the folded pouch material and the material is criss-crossed so that the closure formation is not wound up on itself in a single diameter area of the roll. The closure crosses itself frequently, the result being a wider, but a firmer, more easily handled, roll.

When such a pouch supply roll is introduced to a vertical filling and sealing machine, however, the level wound roll inherently generates problems of its own. Particularly, the material "wanders", "wavers" or traverses a distance equal to the width of the roll, in excess of that of the material, as it is drawn therefrom. In other words, the material and the longitudinally extending closure are not aligned transversely as the material is drawn from the roll. Such wander presents indexing or alignment difficulties in the filling and sealing apparatus, where the alignment and positioning of the pouch material is critical. Should the pouch material "wander" as it is fed to the filling and sealing apparatus, both the filling and sealing operations will either be totally destroyed or, at the least, rendered inoperative to produce uniformly filled and effectively sealed pouches. Seals cannot be uniformly applied and the contents cannot be uniformly placed in the opened pouch. If the material is wandering as it is fed into the filling and sealing apparatus, particularly in a compact, vertical unit, there is simply not enough space or time to correct the difficulty prior to filling and sealing.

Accordingly, it has been one object of this invention to provide methods and apparatus for accurately aligning recloseable pouch material fed from a level wound roll.

It has been a further objective of the invention to provide apparatus for aligning reclosable pouch material from a level wound roll in a minimal horizontal space.

It has been a further objective of the present invention to provide apparatus for aligning a reclosable pouch stock material between a supply roll and a pouch filling station.

To these ends, a preferred embodiment of the invention contemplates a compact material unwind stand providing rotational support for a level wound supply roll of reclosable stock pouch material, an elongated material path of substantially vertical runs and of significant length between the supply roll and a first biased, grooved, alignment roller, a yieldable material loop forming material apparatus, and a second biased, grooved, alignment roller downstream of the loop. The grooved alignment rollers engage the material at the thickened closure formation and guide it along an aligned longitudinal path without significant transverse waver. The material path through the stand primarily comprises three substantially vertical portions or runs maintained within a relatively small horizontal dimension to provide compactness to the unwind stand. The material has some transverse waver through the first two runs but is substantially aligned in the third run. These runs are defined respectively first from the supply roll downwardly to a first turn bar, secondly from the first turn bar upwardly to a second turn bar and associated biased alignment roller means, and thirdly from the second turn bar downwardly through a loop to a third turn bar and associated biased alignment means.

While the minimum length of the first and second runs for efficient operation is not now known, the particular minimum length is believed to be directly related to the transverse distance traversed by the stock material and the closure formation as the material is unwound from the level wind roll. More particularly, if the cumulative length of these two runs is too short, the elongated closure will not uniformly track in the biased grooved alignment roll, but will pull out, destroying the accurate alignment of the material. Of course, the length of the path should not extend too far beyond the minimum, for it does so at the expense of space and material cost.

In the preferred embodiment, it has been found that when a pouch material having a folded width of about 7½ inches is level wound on a reel of about 11½ inches in width, the path of the unwinding closure traverse a distance of about 4 inches. In such an embodiment, the distance of the material from the supply roll to the first turn bar is preferably about 20 inches, while the distance of the material from the first turn bar to the biased alignment roll is about five feet. The length of the third run is variable due to the loop, but may be about four feet. Accordingly, the first run is about five times the transverse waver of the winding material, the second run is about 15 times the transverse waver of the unwinding material and the third run is about 12 times the transverse waver of the unwinding material.

Of course, these dimensions are not exact and may vary with suitable alignment continuing, but this approximate configuration provides a lengthy material stablizing path within a very short horizontal distance. Moreover, with such dimensions, the closure will not pull out of the first grooved alignment roller, but will track therein, aligning the stock material. This provides for a compact unwind stand which provides accurate material tracking without requiring excessive floor space near the vertical filling and sealing apparatus.

Additionally, the unwind stand of the preferred embodiment includes means for lateral adjustment of the biased alignment rollers for accommodation of varying width materials. Particularly, the various biased alignment rollers are mounted to respective horizontal mounting rods. They can be selectively positioned along the rods for properly located the rollers in relation to unwinding material.

Optionally, biased, grooved, alignment rollers are also mounted within the filling and sealing apparatus itself. These do not, however, comprise any portion of the separate unwind stand.

These and other objectives and advantages will become readily apparent from the following detailed description of a preferred embodiment of the invention and from the drawings in which FIG. 1 is a diagramatic view of a reclosable stock pouch material with which the invention is used;

FIG. 5 is an enlarged perspective view of a biased alignment roller; and

Figure 1:
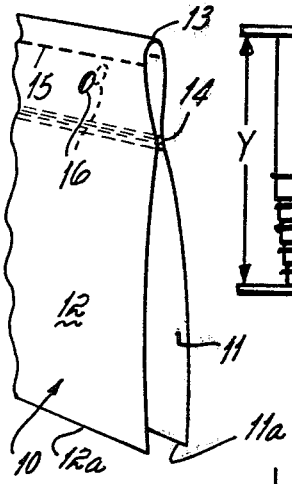
Figure 2:
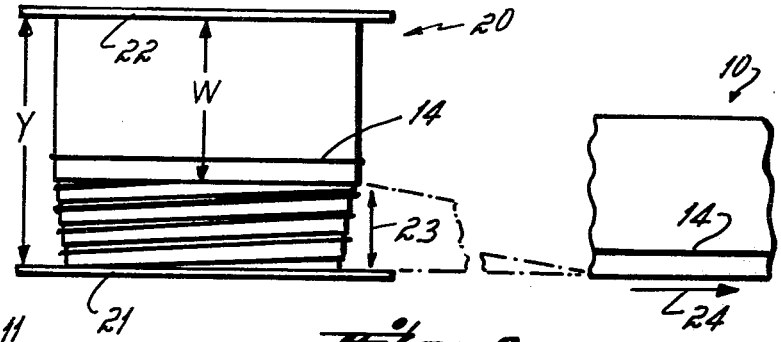
FIG. 2 is a top view of a level wound supply roll of the stock material of FIG. 1, illustrating the traverse of the unwinding material.

Turning now to the drawings, there is shown in FIGS. 1 and 2 thereof an illustration of reclosable stock pouch material of the type to which this invention is directed to handle. Specifically, in FIG. 1 thereof, the reclosable stock pouch material 10 includes a single folded plastic film having sides 11 and 12 folded along the longitudinal fold line 13. Sides 11 and 12 have respective longitudial edges 11*a* and 12*a* and each side 11 and 12 is provided with one element of a closure formation 14.

Closure formation 14 basically comprises a male and a female closure element which may be yieldably joined together to form a closure between the sides 11 and 12. The male and the female elements may take any known suitable configuration, such as, for example, that shown in U.S. Pat. No. 3,338,284; U.S. Pat. No. 3,380,481; or U.S. Pat. No. Re. 28,969. It will be understood that the particular closure formation does not comprise, in and of itself, any portion of the present invention. It will be appreciated, however, that the closure formation 14, when closed, has a thickness which is greater than the thickness of the folded over sides or sheets 11 and 12 in combination. Accordingly, when the stock material 10 is laid on a flat surface, for example, and the sides 11 and 12 are pressed together, the closure formation 14 will protrude upwardly from the compressed sides 11 and 12. It will be further appreciated that the edges 11*a* and 12*a* of the reclosable stock pouch material 10 are not joined together, but rather are left free for closing the pouch after the contents are inserted therebetween. Finally, it will be appreciated that a line of perforations 15 may be provided near the folded over segment of the material 10. After pouch filling and sealing, the top of the pouch defined by the fold line 13 and perforations 15 must be torn off to permit access to the pouch through the closure formation.

As shown then in FIG. 1, the reclosable stock pouch material is provided in a form ready for filling and for sealing. The top area of the pouches is located near the fold line 13 and the bottom area of the to-be-formed pouches is located at the edges 11*a* and 12*a*. Finally, in FIG. 1, it will be appreciated that a plurality of holes 16 may be provided in the region bounded by the closure formation 14 and the line of perforations 15 for the purpose of providing a hanger hole for displaying the package.

More particularly, it will be appreciated that the stock material 10, for example, may be particularly adapted for utilization in a vertical pouch filling and sealing apparatus such as the apparatus shown in U.S. Pat. Nos. 3,083,513; 3,209,513; 3,364,650; or 3,579,404. In a typical one of these filling and sealing apparatus, the stock material is conveyed vertically and downwardly through the apparatus where the sides of the material are spread and the lower side is sealed. The pouch is filled through the bottom, defined by edges 11*a* and 12*a*, and the bottom and the upper side is then sealed and the upper side is cut to separate the pouch from the stock material.

Returning now to the drawings, there is shown in FIG. 2 a supply roll 20 containing a wound supply of reclosable stock material 10 between flanges 21 and 22 of the roll 20. As shown in FIG. 2, the roll 20 constitutes what is known as a level wound roll. That is to say that the flanges 21 and 22 are spaced apart a distance "Y" which is greater than the width "W" of the folded stock material 10. This width "W", of course, corresponds to the top-to-bottom dimension of the pouch, less any selvage scrap cutoff upon sealing.

It will be appreciated that, if the stock material 10 was simply wound on a reel so that the closure formation 14 was wound directly on itself in the same plane, the other edges of the stock material would soon become loose. The diameter of the roll formed through the closure formation 14 would be much greater than that formed through the thinner areas of the stock material formed by the sides 11 and 12. Such a roll in any significant size quickly becomes loose and very difficult to handle. The ends or edges of the roll are floppy and very loose rendering the roll hard to handle or maneuver. In order to eliminate this problem, the stock material 10 is typically provided as rolls 20 with the closure formation being criss-crossed on itself so that the completed and wound roll 20 is more or less level wound between the flanges 21 and 22. While the profile of the material on the roll may not be exactly level or cylindrical, the criss-crossing of the closure formation 14 provides a much more uniform roll with much less diametral variations.

While such a level wound reel provides stock material in a roll form which can be easily handled, it presents another problem in that as the material is unwound from the roll, the closure formation 14 traverses a transverse distance noted by the arrow 23. This leads to difficulties in the utilization of the stock material 10 in vertical filling and sealing apparatus of the type described above. Particularly, it is important to carefully align and track stock material 10 through such vertical sealing apparatus. Without such alignment, the material will be improperly placed with respect to the positioning of the contents of the to-be-formed pouches. Similarly, the edges of the stock material will not be in the appropriate position for handling and sealing within the filling and sealing apparatus. If the stock material cannot be accurately guided, it cannot be uniformly filled, sealed and cut to form individual pouches.

Accordingly, it is necessary to accurately align and to track the stock material 10 such that the closure formation 14 does not traverse the distance indicated by the arrow 23, but rather is longitudinally aligned and guided, for example, as indicated by the arrow 24 without any significant traversing movement. It is to the handling of the supply roll 20 and the tracking and alignment of the stock material 10 as it is supplied to a vertical filling and sealing apparatus that this invention is directed.

Figure 3:
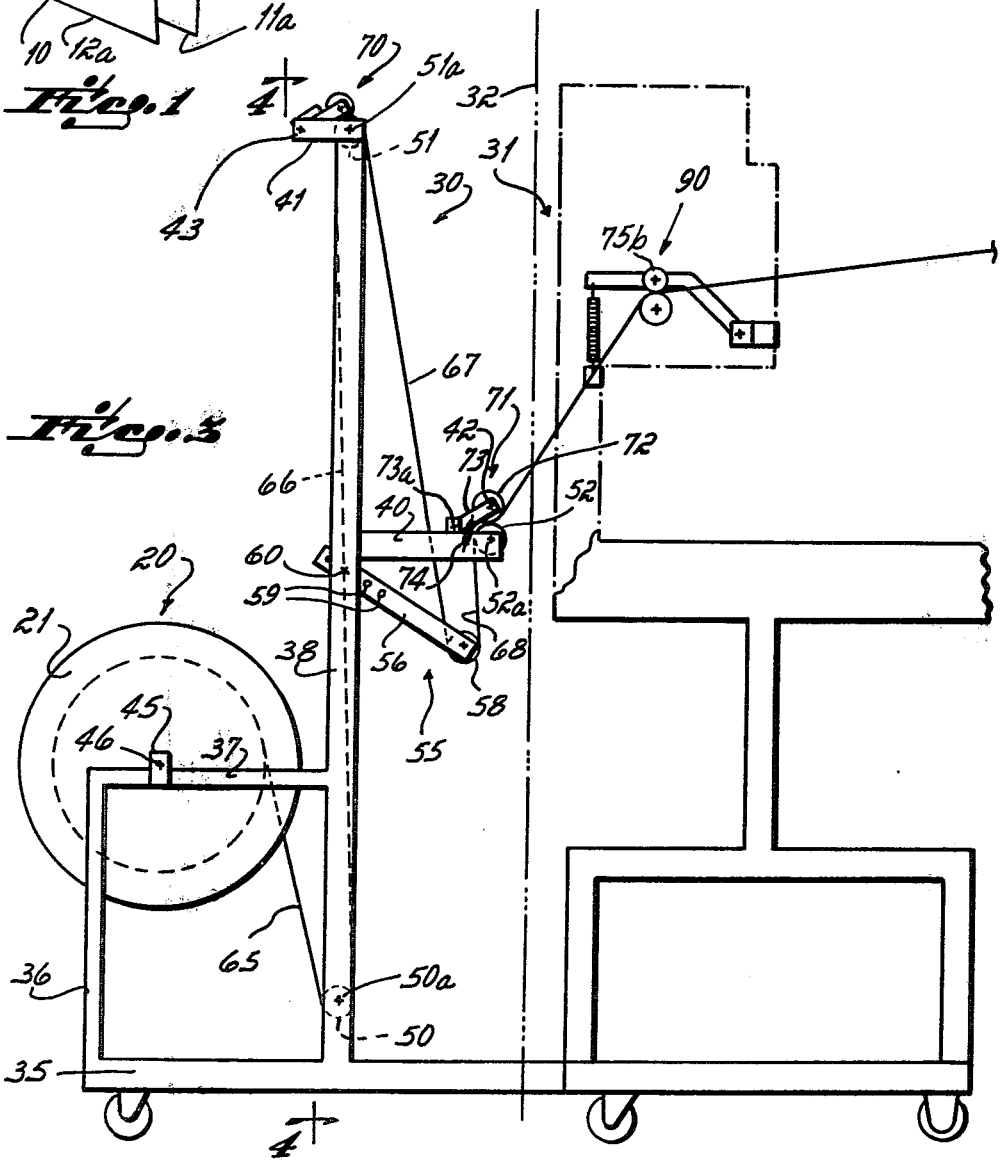
FIG. 3 is a diagramatic elevational view of a preferred embodiment of the invention, together with a vertical filling and sealing apparatus.

Turning now to FIG. 3, a preferred embodiment of the invention includes an unwind stand 30 which is particularly adapted for the handling of supply roll 20 of reclosable pouch stock material 10 and the feeding of aligned stock material 10 to a pouch filling and sealing apparatus such as that shown diagramatically at 31 in FIG. 3. It will be appreciated that FIG. 3 illustrates the preferred embodiment 30 of the invention in combination with a pouch filling and sealing apparatus 31. It will be further appreciated that the unwind stand 30 may constitute a separate and independent apparatus from the filling and sealing apparatus 31. For clarity, the phantom line 32 has been used in this application to separate the structure of the unwind stand 30 from that of the filling and sealing apparatus 31.

Figure 4:
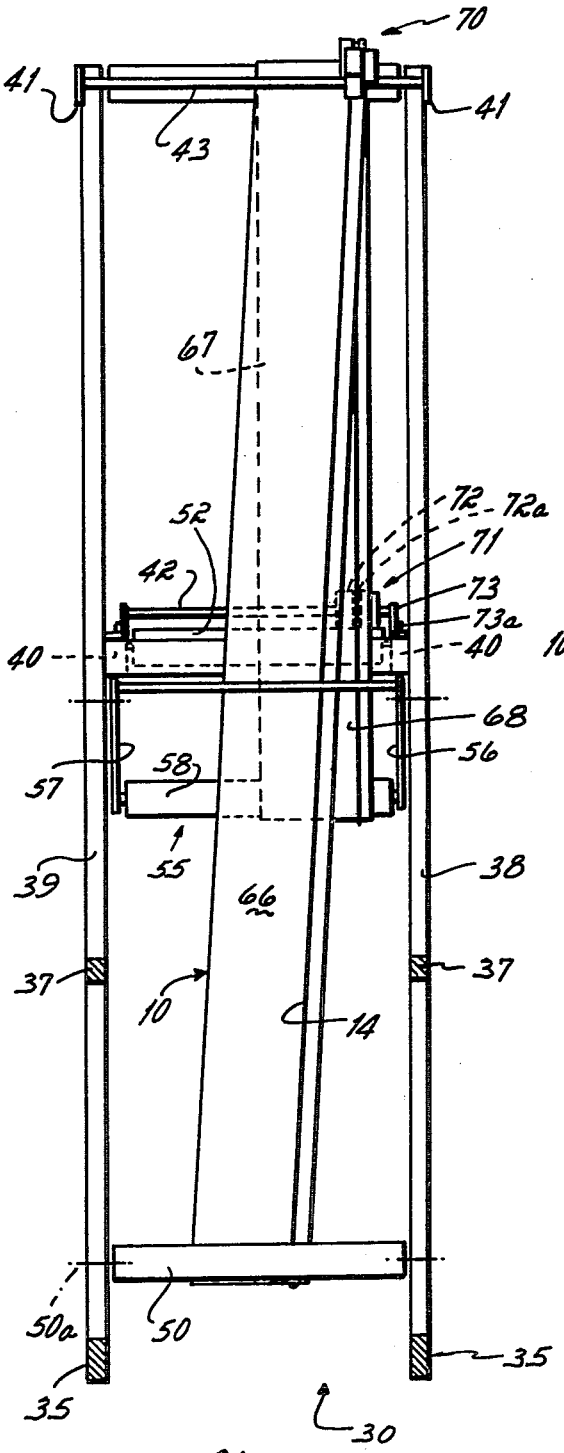
FIG. 4 is a cross-sectional view taken along lines 4—4 of FIG. 3.

Turning now to the unwind stand 30, it comprises a frame including a base 35, roll support members 36 and 37, upright standards 38 and 39 (FIG. 4), support members 40 (only one of which is shown in FIG. 3) and support members 41 (FIG. 4). Support members 40 support a rod 42 therebetween, and support members 41 support a rod 43 therebetween.

The unwind stand 30 provides a means for rotationally supporting the roll 20 and defines a material path for the stock material 10 from the roll 20 and through the unwind stand to a discharge point. More particularly, the unwind stand 30 includes bearing means 45 for supporting the roll 20 for rotation about a horizontal axis 46. The bearing means, of course, may comprise a bearing mounted axle or other means for journaling the roll 20. The material path through the wind-up stand is defined by a roll 20 on the bearing means 45, a first turn bar 50, a second turn bar 51, and a third turn bar 52. The material 10 travels around each of these turn bars, which may in themselves comprise rollers, for example, as it unwinds from the roll 20.

Turn bars 50 and 51 are disposed between the upright standards 38 and 39. Turn bar 52 is mounted between the support members 40.

A loop forming means 55 is disposed between the second and third turn bars. The loop forming means comprise pivoted swing arms 56 and 57, respectively mounted mean ends thereof to the upright standards 38 and 39. A loop forming roller 58 is mounted near another end of each of the swing arms for engaging the material 10 and forming a loop therein. The loop in the material is formed by means of the weight of the swing arms 56 and the roller 58 resting in the material 10. Optionally, spring means may be used to bias the roller 58 against the material. It will be appreciated that the bias of the loop forming means against the material can be controlled by the adjustable mounting of the swing arms 56 and 57 to the upright standards 38 and 39 by means of the adjustment pivot apertures 59, all of which can be selected to pivot the swing arms 56 and 57 about the axis 60.

It will be further appreciated that each of the turn bars is mounted about a respective horizontal axis noted at 50*a*, 51*a* and 52*a*, respectively and, that in this preferred embodiment, each of these axes are parallel to each other and reside in vertical parallel planes which are relatively closely horizontally spaced. Moreover, axes 50*a* and 51*a* reside in the same vertical plane. Each of the axes are also parallel to the axis of rotation 46 of the roll 20.

The material path is thus divided into several distinct substantially vertical portions or runs, as best seen in FIG. 3. A first run 65 extends from the roll 20 to the turn bar 50. A second run 66 extends upwardly from the turn bar 50 to the turn bar 51. A third run 67 extends from the turn bar 51 to the turn bar 52 and includes the loop 68. It will thus also be appreciated that the entire material path is substantially vertically disposed within the unwind stand 30. Particularly, it will be appreciated that the first portion 65 of the material path descends from the roll 20 to the turn bar 50. The second portion 66 of the material path extends nearly vertically upwardly from the turn bar 50 to the turn bar 51. The third portion 67 of the material path then extends downwardly from the turn bar 51 to the turn bar 52 and includes vertical portions of the loop 68. Accordingly, it will be appreciated that a rather lengthy material path is provided within a relatively short horizontal distance by constructing the unwind stand of a heighth sufficient to accommodate the extensive length of the material path. Such height can be similar to, for example, the height of a vertical filling and sealing apparatus 31, such as shown in FIG. 3.

Turning now to the means for guiding and aligning the material 10 through the unwind stand, there is provided a plurality of biased, grooved, alignment roller means. A first biased alignment roller means 70 is disposed in cooperative relationship with the turn bar 51, and a second spring biased alignment roller means 71 is disposed in cooperative relationship with the turn bar 52.

Turning now to the details of the biased alignment roller means 70 in FIG. 5, it includes a grooved roller 75 provided with a circumferential groove 76 therein. The roller 75 is journaled at 75*a* to a swing arm 77 which itself is pivoted at 78 to a mounting block 79. A spring means, such as a coil spring 80, is disposed between a leg 79*a* of the mounting block and a pin 81 extending outwardly from a side of the swing arm 77. The spring 80 is thus operable to bias swing arm 77 in a clockwise direction, as viewed in FIG. 5, about the pivot 78. A stop pin 82 is provided in mounting block 79 for the purpose of providing a swing arm stop. The stop pin 82 is disposed at a position lower than the swing arm 77 would ordinarily reach when engaging the material 10.

A swing bracket 85 is pivotally secured to a face of the mounting block 79 by means of a bolt 86. The swing bracket 85 includes a slot 87 which can be pivoted around the locking bolt 88. When the bolts 86 and 88 are tightened, this biases the swing bracket 85 toward the mounting block 79. When the mounting block is mounted on a rod such as rod 43, for example, the tightening of the bolts 86 and 88 thus serve to clamp the block, by means of the swing bracket 85 to the rod 43 and thus holds the entire biased alignment roller means in position on the rod 43. It will be appreciated that through means of the swing bracket 85, the biased alignment roller means may be adjusted along the support member or rod 43 to accommodate adjustment of the biased alignment roller means as needed in a transverse direction.

Figure 6:
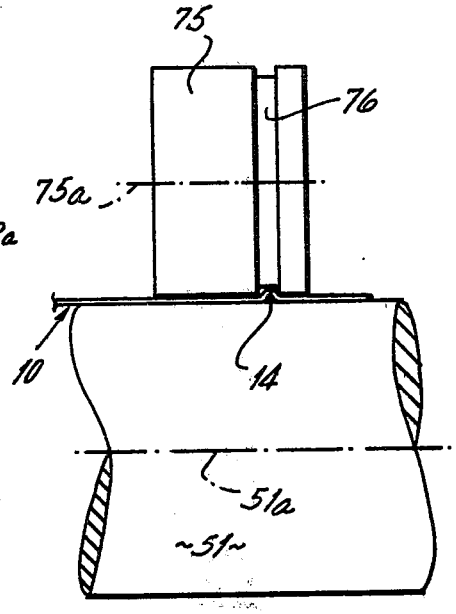
FIG. 6 is a detailed view of the engagement of a biased alignment roller with reclosable stock pouch material.
Figure 3:
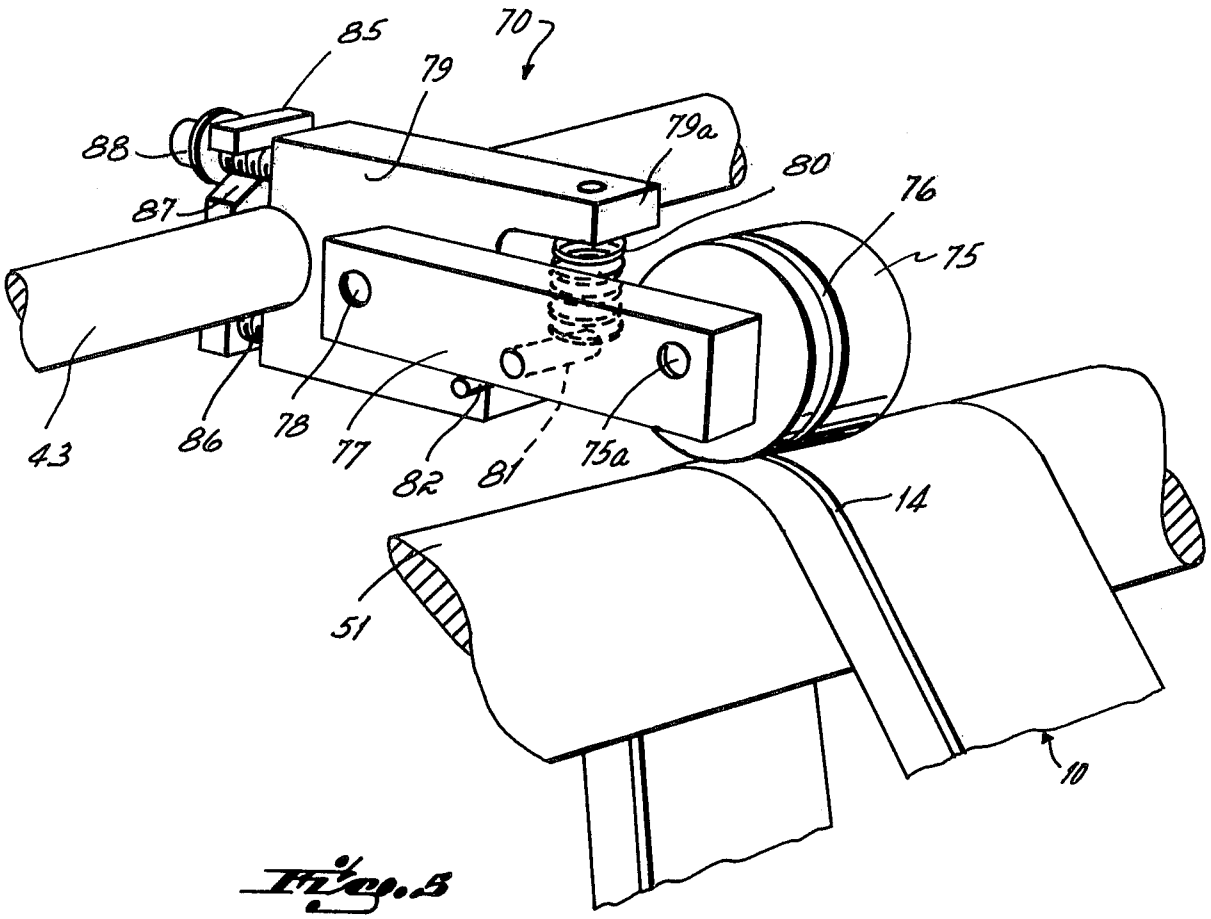

As the material 10 is drawn around the turn bar, such as turn bar 51, the sides 11 and 12 are relatively flat. The closure formation 14, however, is thick and extends or protrudes upwardly from the turn bar 51, a greater distance than the combined thicknesses of the sides 11 and 12. This relationship is best seen in FIG. 6. In the preferred embodiment, the groove is preferably formed to have a width approximately twice the width of the closure formation 14. At the same time, the depth of the groove is only slightly greater than the thickness of the closure formation 14. In the preferred embodiment, then, the groove 76 may be approximately $\frac{1}{8}$ of an inch wide and about 1/16 of an inch deep. In a typical stock pouch material 10, this dimension would result in approximately 0.010 to 0.015 inches of tolerance to accommodate variations in the thickness of the closure formation 14.

It will be appreciated then that the groove 76 provides a direct engagement and guidance for closure formation 14 and, thus, the entire stock material 10, as the material is passed through the unwind stand. The closure formation 14 traverses a distance 23 (FIG. 2) at the area of the supply roll 20. When the material, however, reaches the first biased alignment roller means 70, the roller 75 and the circumferential groove 76 serve to engage the closure formation 14 and to position the material 10 in a steady longitudinal direction without any significant transverse waver or wander. This alignment is shown illustratively in FIG. 2.

Spring biased alignment roller means 71 can be contracted identically to roller means 70 or, as illustrated in FIG. 3, it may have a different construction. Particularly, roller means 71 includes a circumferentially grooved roller 72 with a groove 72*a* identical to groove 76 in roller 75. Roller 72 is rotationally mounted on rod 42 and axially secured by selectively releasable set collars (not shown) or other suitable means. Rod 42 is carried by swing arms 73 which in turn are journalled on pins 73*a* mounted on support members 40. A spring 73 is attached to swing arm 72 and to support member 40 for biasing roller 72 against the material 10 on turn bar 52.

In FIG. 4, the stock material 10 is shown in a position which it may assume, for example, when the material is being fed from the center of the supply reel 20, rather than from the side of the supply reel 20 and, thus, the material 10 in FIG. 4 is shown in its extreme transverse position. It will be appreciated that such a position of the material 10 tends to pull the downstream material toward the transverse position that the material has assumed on the supply reel 20. The engagement of the roller 75 and groove 76, with the closure formation 14, however, biases the material transversely into an aligned position and against this tendency to waver. The material 10 is further held in transverse alignment by the second biased alignment roller means 71, as the material exits from the loop 68.

If the distance between the roll 20 and the first biased alignment roller means 70 is too short, the closure formation 14 could be pulled under the roll 75 and out of the groove 76, thus causing misalignment and defeating the purpose of the biased alignment roller means. Accordingly, it is necessary to provide a minimum distance between the unwinding supply roll 20 and the first alignment means. This distance is provided by the first and second portions 65 and 66 of the material path.

While the specific minimum material path distances are not precisely known at this time, it will be appreciated that the minimum distance required is that which will be long enough so as to not pull the material 10 and the formation 14 transversely out of the groove 76. While the lengths of the material path may vary depending on the initial film wander or trasverse 23, for example, and still remain within the scope of this invention, the preferred embodiment contemplates a total transverse waver 23 of about four inches for a pouch material width of approximately $7\frac{1}{2}$ inches. That is, the distance from the bottom to the top of the pouch material, defined by the longitudinal edges 11*a* and 12*a* of the stock pouch material to fold line 13, is about $7\frac{1}{2}$ inches. When such a stock pouch material is wound on a level wound roll 20, suitable level winding can be achieved where the roll is approximately four inches wider than the width of the pouch material. Accordingly, as viewed in FIG. 2, the width "W" of the pouch material, in a preferred embodiment, equals about $7\frac{1}{2}$ inches, while the width "Y" of the entire level wound supply roll equals approximately $11\frac{1}{2}$ inches. This provides for a transverse movement 23, of the closure formation 14, of about four inches. Of course, the pouch material width may vary significantly as will, then, the width of the level wound supply roll 20. Nevertheless, for this particular pouch material of about $7\frac{1}{2}$ inches in width, I have found it suitable for effective alignment and tracking purposes that the first run 65 of the material path be approximately four times the trasverse distance 23 of the pouch material and the second run 66 be approximately fifteen times the traverse distance 23 of the material. Further, in the preferred embodiment, the third material path portion 67 is preferrably about twelve times the traverse distance 23 of the pouch material. With these dimensions, the unwinding film, having a closure formation 14 transversely moving approximately four inches as it is unwound, will be effectively tracked and aligned through the unwind stand, there being a distance of approximately 20 times the distance of the transverse waver between the unrolling material and the first biased alignment roller means.

Additionally, it should be appreciated that, in order to continue the material tracking through the vertical pouch filling and sealing machine 31, a biased alignment roller means 90, having a circumferentially grooved roller 75*b*, or other means may be provided in the apparatus 31 in order to maintain the appropriate tracking of the film. Whether or not such further means are utilized to guide the film within the apparatus 31, it will be appreciated that the unwind stand 30, as described herein, provides highly efficient means for unwinding a stock material 10 having a thickened closure formation 14 therein, and for accurately aligning the stock material 10 as it is unwound from the level wound roll 20, while at the same time providing a loop in the material to accommodate intermittent operation, for example of any filling and sealing apparatus with which the unwinding stand 30 is utilized.

Further, it will be appreciated that the axes 46, 50*a*, 51*a* and 52*a* all lie within vertical planes, for example, which are parallel to each other, and that the total horizontal difference or distance between the plane of the axis 46 and the vertical plane through the axis 52*a* is relatively short, while at the same time the material path is a relatively long one with respect to the waver of the film as it is unwound from the roll 20. By these means then, the unwind stand 30 may be provided in a relatively compact horizontal space, thereby conserving floor space and eliminating any need for an elongated apparatus for unwinding and feeding material to any filling and sealing apparatus 31.

Having now described a preferred embodiment of the invention, other modifications and alterations will become readily apparent to those of ordinary skill in the art without departing from the scope of this invention, and the applicant intends to be bound only by the claims appended hereto.

I claim:

1. An unwind stand for unwinding and aligning reclosable stock pouch material, having a longitudinal closure formation, from a level wound supply roll, said stand defining an unwind path for said material, said stand comprising:

a frame;

means for rotationally supporting said roll on said frame;

first material turn bar means spaced from said roll;

a second material turn bar means spaced above said first turn bar means, for supporting said material;

a first biased alignment roll means in cooperative disposition with respect to said second turn bar means for aligning said material;

a third material turn bar means for supporting said material;

a second biased alignment roll means in cooperative disposition with said third turn bar means;

material loop forming means disposed between said second and third turn bar means; and wherein said material traverses a predetermined transverse distance when unwound from said roll, the length of said unwind path from said roll to said second material turn bar means being sufficiently long to permit constant alignment of said material by engagement of said first biased alignment roll means with said closure formation.

2. Apparatus as in claim 1 wherein said material traverses through a predetermined distance in a transverse direction as it is unwound from each roll, and wherein the length of the material path between the roll and the first turn bar means is about five times the distance traversed by said material.

3. Apparatus as in claim 2 wherein the length of the material path between the first turn bar means and the second turn bar means is about fifteen times the distance traversed by said material.

4. Apparatus as in claim 3 wherein the length of the material path from the second turn bar means to the third turn bar means is about 12 times the distance traversed by said material.

5. Apparatus as in claim 1 wherein said first biased alignment roll means include:

a circumferentially grooved roller;

a mounting block;

a swing bar pivoted at one end to said mounting block, said roller rotationally mounted on another end of said swing bar; and swing means mounted between said mounting block and said swing bar for urging said roller against said material on the associated turn bar means.

6. Apparatus as in claim 5 wherein said circumferential groove engages said longitudinal closure formation and aligns said formation in a transverse direction.

7. Apparatus as in claim 5 further including a swing bracket means pivoted to a face of said mounting block, and means to bias said bracket toward said block, for clamping a support element therebetween.

8. Apparatus as in claim 7 wherein said support element comprises a rod mounted in said frame and wherein said mounting block is selectively adjustable along said rod.

9. Apparatus as in claim 1 wherein said loop forming means includes a swing arm pivoted to said frame and a material engaging loop forming roller means rotationally mounted on said arm and resting on said material, forming a loop therein between said second and third turn bar means.

10. Apparatus as in claim 1 wherein said second biased alignment roll means comprises, a circumferentially grooved roller;

a rod, said roller rotationally mounted on said rod in a selected axial position;

two swing arms pivoted at respective ends thereof to said frame, said rod connected to other respective ends of said swing arms for swinging movement; and spring means connected between said swing arm and said frame for biasing said roller into operative engagement with said stock pouch material on said third material turn bar.

11. An unwind stand for unwinding and aligning reclosable stock pouch material, of the type having a longitudinal protruding closure formation therein, from a level wound supply roll, said stand defining a path for said material and comprising, a frame;

means for journalling said roll for rotation on an axis in said frame;

a first material turn bar spaced from said roll, vertically from said axis and defining, with said roll, a first portion of said path;

a second material turn bar disposed on an opposite side of said axis from said first turn bar and defining, with said first turn bar, a substantially vertical second portion of said path;

a first biased alignment roll means disposed in proximity to said second turn bar for engaging and aligning material on said second turn bar;

a third turn bar;

material loop forming means; and said second and third turn bars and said loop forming means defining a third portion of said material path, including a loop in said material between said second and third turn bars.

12. Apparatus as in claim 11 wherein said material traverses a predetermined transverse distance as it is unwound from said roll, and wherein said first portion of said path has a length about five times the distance traversed by said material.

13. Apparatus as in claim 11 wherein said material traverses a predetermined transverse distance as it is unwound from said roll, and wherein said second portion of said path has a length about 15 times the distance traversed by said material.

14. Apparatus as in claim 11 or 13 wherein said material traverses a predetermined transverse distance as it is unwound from said roll, and wherein said third portion of said path has a length about 12 times the distance traversed by said material.

15. Apparatus as in claim 11 wherein said material has a predetermined width, said third turn bar has an axis parallel to said journal axis in said frame, and said axes reside in spaced, parallel, vertical planes, the horizontal distance between such planes being about three times said predetermined width of said material.

16. Apparatus as in claim 15 wherein said first and second portions of said material path have a length about 20 times said distance traversed by said material when it is unwound from said roll.

17. Apparatus as in claim 16 wherein said first, second and third portions of said path are substantially vertically disposed.

18. A method for aligning folded reclosable stock pouch material, having a longitudinal and protruding closure formation, as the material is unwound from a level wind roll and wherein said closure formation in the material wavers through a known transverse distance as the material is unwound, the method comprising the steps of:

unwinding said material from said roll;

passing said material through a first run and around a first turn bar;

passing said material through a second run from said first turn bar to a second turn bar; and engaging said closure formation at said second turn bar and aligning said material, by said engagement, with respect to movement in a transverse direction.

19. A method as in claim 18 wherein said two passing steps include passing said material through a distance of about 20 times the distance of said transverse waver distance.

20. A method as in claim 19 including the further step of passing said material from said second turn bar through a third run to a third turn bar.

21. A method as in claim 20 including engaging said closure formation at said third turn bar and aligning said material, by said engagement, with respect to movement in a transverse direction.

22. A method as in claim 21 including forming a loop in said material in said third run.

23. A method as in claim 22 wherein the further step of passing said material through said third run includes passing said material through a distance of about 12 times the distance of said transverse waver distance.

* * * * *